US010829953B2

(12) United States Patent
Esterle et al.

(10) Patent No.: US 10,829,953 B2
(45) Date of Patent: Nov. 10, 2020

(54) DAMPED CLOSURE ASSEMBLY FOR A MICROWAVE OVEN

(71) Applicant: Haier US Appliance Solutions, Inc., Wilmington, DE (US)

(72) Inventors: Christopher D. Esterle, Louisville, KY (US); Mark Aaron Weaver, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 329 days.

(21) Appl. No.: 15/838,609

(22) Filed: Dec. 12, 2017

(65) Prior Publication Data

US 2019/0178001 A1 Jun. 13, 2019

(51) Int. Cl.

| | |
|---|---|
| ***E05B 17/00*** | (2006.01) |
| ***H05B 6/64*** | (2006.01) |
| ***E05B 65/06*** | (2006.01) |
| ***E05C 3/12*** | (2006.01) |
| ***E05B 15/04*** | (2006.01) |
| ***E05C 19/02*** | (2006.01) |

(52) U.S. Cl.

CPC ..... *E05B 17/0041* (2013.01); *E05B 15/04* (2013.01); *E05B 17/0045* (2013.01); *E05B 65/06* (2013.01); *E05C 3/12* (2013.01); *E05C 19/024* (2013.01); *H05B 6/6414* (2013.01); *H05B 6/6417* (2013.01); *E05B 2015/0493* (2013.01)

(58) Field of Classification Search

CPC .. E05B 17/0041; E05B 17/0045; E05B 15/04; E05B 65/06; E05C 19/024; E05C 3/12; H05B 6/6414; H05B 6/6417; H05B 2015/0493

See application file for complete search history.

(56) References Cited

U.S. PATENT DOCUMENTS

| | | | | |
|---|---|---|---|---|
| 3,642,313 | A | 2/1972 | Anderson | |
| 4,457,545 | A * | 7/1984 | Wilson | H05B 6/6417 292/29 |
| 8,376,418 | B2 | 2/2013 | Osvatic et al. | |
| 2001/0009256 | A1* | 7/2001 | Nasu | F24C 7/082 219/739 |
| 2005/0194795 | A1 | 9/2005 | Hapke et al. | |
| 2008/0295283 | A1 | 12/2008 | Tice | |
| 2010/0140261 | A1* | 6/2010 | Kim | H05B 6/6414 219/740 |

(Continued)

FOREIGN PATENT DOCUMENTS

| | | | |
|---|---|---|---|
| CN | 102080838 B | * | 9/2013 |
| CN | 102080838 B | | 9/2013 |

(Continued)

*Primary Examiner* — Donnell A Long

(74) *Attorney, Agent, or Firm* — Dority & Manning, P.A.

(57) ABSTRACT

A damped closure assembly for a microwave oven includes a catch element mounted to a cabinet of the microwave oven. A striker defined on a door of the microwave oven engages the catch element which is rotatable between an open position and a closed position. A spring mechanism and a damping element are operably coupled to the catch element to slowly urge the catch element and the door toward the closed position to prevent slamming, loud noises, and potential wear on one or more components of the microwave oven when the door is closed.

20 Claims, 5 Drawing Sheets

(56) References Cited

U.S. PATENT DOCUMENTS

| | | | | |
|---|---|---|---|---|
| 2010/0187225 | A1* | 7/2010 | Park | H05B 6/6426 219/757 |
| 2015/0021927 | A1 | 1/2015 | Wang | |
| 2015/0282257 | A1* | 10/2015 | Hoare | H05B 6/6411 219/719 |
| 2016/0348414 | A1* | 12/2016 | Ivanovic | H05B 6/6414 |

FOREIGN PATENT DOCUMENTS

| | | | |
|---|---|---|---|
| CN | 104269289 | A | 1/2015 |
| CN | 206053603 | U | 3/2017 |
| JP | 4337243 | B2 | 9/2009 |

* cited by examiner

DAMPED CLOSURE ASSEMBLY FOR A MICROWAVE OVEN

FIELD OF THE INVENTION

The present subject matter relates generally to microwave oven appliances, and more particularly to improved door closure mechanisms for microwave oven appliances.

BACKGROUND OF THE INVENTION

Microwave oven appliances generally include a cabinet that defines a cooking chamber for receipt of food items for cooking. In order to provide selective access to the cooking chamber and to contain food particles and cooking energy (e.g. microwaves) during a cooking operation, microwave appliances further include a door that is typically pivotally mounted to the cabinet. A door latch mechanism or assembly is typically provided for latching the door in the closed position and providing an indication to a controller that the door is closed and that the microwave oven may be safely operated.

Notably, however, conventional latch mechanisms use a spring and latch assembly that causes the doors to close very abruptly. In this regard, the latch mechanisms include spring which rapidly draws the latch or striker into the closed position, thereby slamming the door into its closed position. Such a large closing velocity of the microwave door generates a very loud closing noise and potentially causes damage or premature wear to one or more microwave components.

Accordingly, a microwave oven with an improved door latching mechanism would be useful. More specifically, a door closure assembly or mechanism that can slowly close a door of a microwave oven would be particularly beneficial.

BRIEF DESCRIPTION OF THE INVENTION

The present subject matter provides a damped closure assembly for a microwave oven which includes a catch element mounted to a cabinet of the microwave oven. A striker defined on a door of the microwave oven engages the catch element which is rotatable between an open position and a closed position. A spring mechanism and a damping element are operably coupled to the catch element to slowly urge the catch element and the door toward the closed position to prevent slamming, loud noises, and potential wear on one or more components of the microwave oven when the door is closed. Additional aspects and advantages of the invention will be set forth in part in the following description, may be apparent from the description, or may be learned through practice of the invention.

In one aspect of the present disclosure, a microwave oven defining a vertical, a lateral, and a transverse direction is provided. The microwave oven includes a cabinet defining a cooking chamber and a door rotatably mounted to the cabinet for providing selective access to the cooking chamber, the door comprising a striker mounted to the door. A damped closure assembly is mounted to the cabinet and includes a catch element mounted to the cabinet, the catch element being rotatable between an open position and a closed position, the catch element being configured for engaging the striker when the catch element is moved toward the closed position. A spring mechanism is operably coupled to the catch element, the spring mechanism being positioned and oriented for urging the catch element toward the open position when the catch element is positioned between the open position and an over-center position and for urging the catch element toward the closed position when the catch element is positioned between the over-center position and the closed position. A damping element is operably coupled to the catch element for damping the rotation of the catch element toward the closed position.

In another aspect of the present disclosure, a damped closure assembly for an oven appliance is provided. The oven appliance includes a cabinet defining a cooking chamber and a door for providing selective access to the cooking chamber. The damped closure assembly includes a catch element mounted to the cabinet, the catch element being rotatable between an open position and a closed position, the catch element being configured for engaging a door striker when the catch element is moved toward the closed position. A spring mechanism is operably coupled to the catch element, the spring mechanism being positioned and oriented for urging the catch element toward the open position when the catch element is positioned between the open position and an over-center position and for urging the catch element toward the closed position when the catch element is positioned between the over-center position and the closed position. A damping element is operably coupled to the catch element for damping the rotation of the catch element toward the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
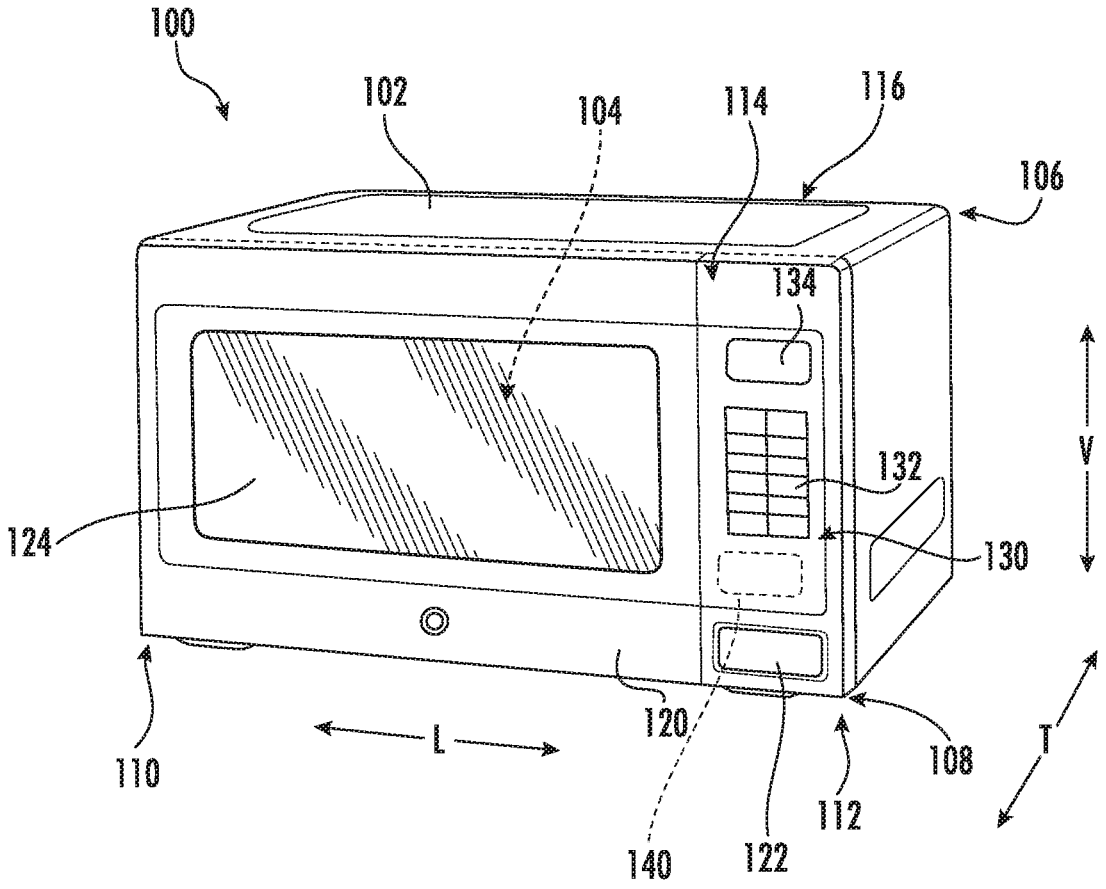
FIG. 1 provides a perspective view of a microwave oven appliance in accordance with an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of a microwave oven 100 as may be employed with the present subject matter. Microwave oven 100 includes an insulated cabinet 102. Cabinet 102 defines a cooking chamber 104 for receipt of food items for cooking. As will be understood by those skilled in the art, microwave oven 100 is provided by way of example only, and the present subject matter may be used in any suitable microwave oven, such as a countertop microwave oven, an over-the-range microwave oven, etc. In addition, aspects of the present subject matter may be used in other suitable residential or commercial appliances, e.g., a gas or electric oven range appliance, a dishwasher, a washing machine, a refrigerator appliance, etc. Thus, the example embodiment shown in FIG. 1 is not intended to limit the present subject matter to any particular cooking chamber configuration or arrangement.

As illustrated, microwave oven 100 generally defines a vertical direction V, a lateral direction L, and a transverse direction T, each of which is mutually perpendicular, such that an orthogonal coordinate system is generally defined. Cabinet 102 of microwave oven 100 extends between a top 106 and a bottom 108 along the vertical direction V, between a first side 110 (left side when viewed from front) and a second side 112 (right side when viewed from front) along the lateral direction L, and between a front 114 and a rear 116 along the transverse direction T.

Microwave oven 100 includes a door 120 that is rotatably attached to cabinet 102 in order to permit selective access to cooking chamber 104. A handle may be mounted to door 120 to assist a user with opening and closing door 120 in order to access cooking chamber 104. As an example, a user can pull on the handle mounted to door 120 to open or close door 120 and access cooking chamber 104. Alternatively, microwave oven 100 may include a door release button 122 that disengages or otherwise pushes open door 120 when depressed. Glass window panes 124 provide for viewing the contents of cooking chamber 104 when door 120 is closed and also assist with insulating cooking chamber 104.

Microwave oven 100 is generally configured to heat articles, e.g., food or beverages, within cooking chamber 104 using electromagnetic radiation. Microwave appliance 100 may include various components which operate to produce the electromagnetic radiation, as is generally understood. For example, microwave appliance 100 may include a magnetron (such as, for example, a cavity magnetron), a high voltage transformer, a high voltage capacitor and a high voltage diode. The transformer may provide energy from a suitable energy source (such as an electrical outlet) to the magnetron. The magnetron may convert the energy to electromagnetic radiation, specifically microwave radiation. The capacitor generally connects the magnetron and transformer, such as via high voltage diode, to a chassis. Microwave radiation produced by the magnetron may be transmitted through a waveguide to the cooking chamber.

The structure and intended function of microwave ovens are generally understood by those of ordinary skill in the art and are not described in further detail herein. According to alternative embodiments, microwave oven may include one or more heating elements, such as electric resistance heating elements, gas burners, other microwave heating elements, halogen heating elements, or suitable combinations thereof, are positioned within cooking chamber 104 for heating cooking chamber 104 and food items positioned therein.

Referring again to FIG. 1, a user interface panel 130 and a user input device 132 may be positioned on an exterior of the cabinet 102. The user interface panel 130 may represent a general purpose Input/Output ("GPIO") device or functional block. In some embodiments, the user interface panel 130 may include or be in operative communication with user input device 132, such as one or more of a variety of digital, analog, electrical, mechanical or electro-mechanical input devices including rotary dials, control knobs, push buttons, and touch pads. The user input device 132 is generally positioned proximate to the user interface panel 130, and in some embodiments, the user input device 132 may be positioned on the user interface panel 130. The user interface panel 130 may include a display component 134, such as a digital or analog display device designed to provide operational feedback to a user.

Generally, microwave oven 100 may include a controller 140 in operative communication with the user input device 132. The user interface panel 130 of the microwave oven 100 may be in communication with the controller 140 via, for example, one or more signal lines or shared communication busses, and signals generated in controller 140 operate microwave oven 100 in response to user input via the user input devices 132. Input/Output ("I/O") signals may be routed between controller 140 and various operational components of microwave oven 100. Operation of microwave oven 100 can be regulated by the controller 140 that is operatively coupled to the user interface panel 130.

Controller 140 is a "processing device" or "controller" and may be embodied as described herein. Controller 140 may include a memory and one or more microprocessors, microcontrollers, application-specific integrated circuits (ASICS), CPUs or the like, such as general or special purpose microprocessors operable to execute programming instructions or micro-control code associated with operation of microwave oven 100, and controller 140 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, a controller 140 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Referring now to FIGS. 2 through 6, microwave oven 100 further includes one or more door latches or strikers, such as strikers 150, which are defined by or mounted to door 120 for locking door 120 in a closed position prior to operating microwave oven 100. For simplicity, only one striker 150 will be described herein. However, it should be appreciated that any suitable number, style, configuration, and orientation of strikers may be used according to alternative embodiments. For example, microwave oven 100 may include two strikers 150 and two damped closure assemblies 200, but it should be appreciated that more or fewer may be used according to alternative embodiments. As illustrated, striker 150 protrudes from door 120 (e.g., along the transverse direction T when door 120 is in the closed position) toward cabinet 102 for engaging a damped closure assembly 200 (as will be described below according to an exemplary embodiment).

More specifically, according to an exemplary embodiment, cabinet 102 includes a front panel 152 which defines one or more openings 154 that are generally configured for receiving one or more strikers 150. More specifically, microwave oven 100 may have a front panel 152 that defines a top and a bottom opening 154 which are configured for receiving a top and a bottom striker 150, respectively, when door 120 moves toward the closed position. According to exemplary embodiments, openings 154 may be sized and positioned for receiving strikers 150 while preventing other items from being inserted through opening 154. In addition, damped closure assembly may not be visible through openings 154 to provide a clean look to the front of microwave oven 100. However, it should be appreciated that front panel 152 and openings 154 are not required according to alternative embodiments.

Notably, conventional microwave oven appliances use a door closure mechanism that has a spring-loaded latch that snaps onto, latches, or otherwise engages a striker on the microwave door. However, such microwave oven appliances commonly generate a very loud noise when the closing mechanism engages the striker. These loud noises can degrade the user experience of the appliance as well as cause stress-related failures of the striker and/or latch mechanism.

Figure 2:
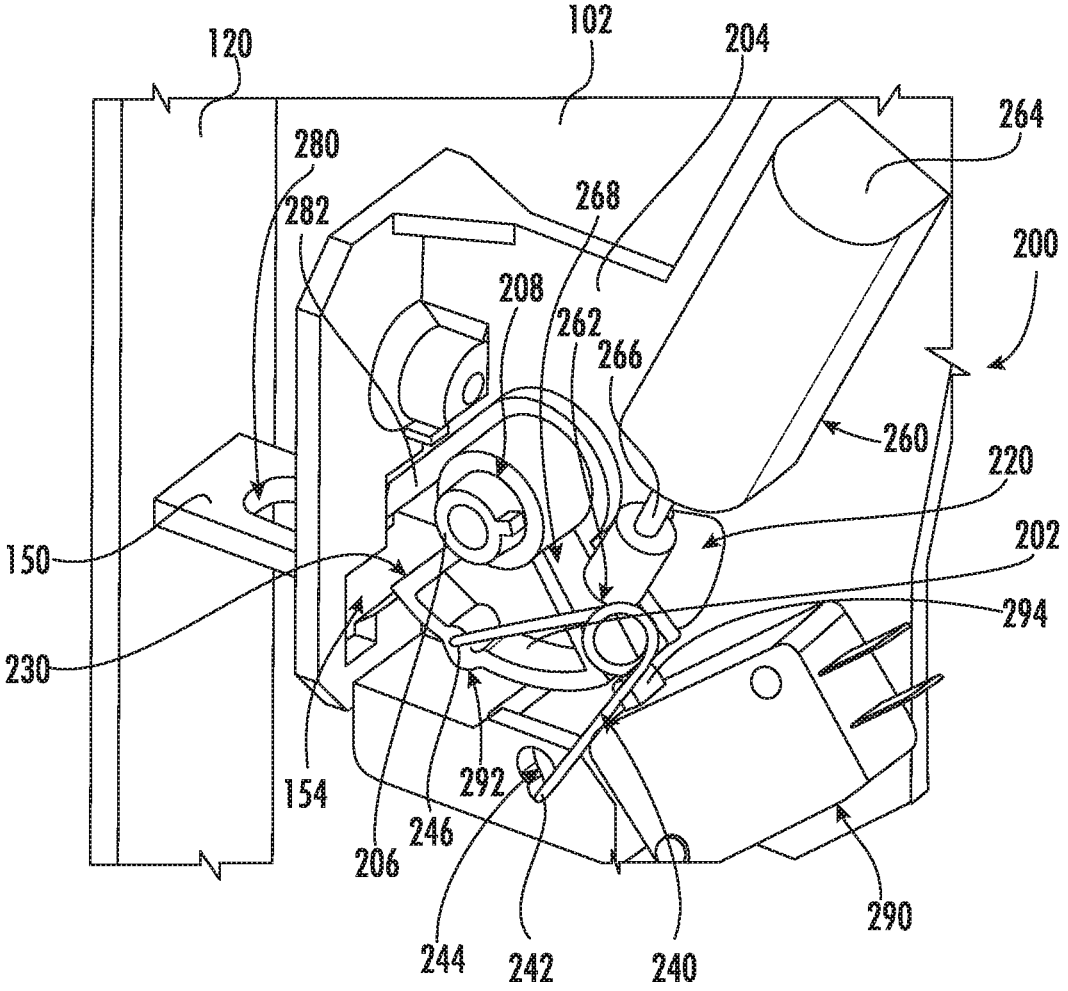
FIG. 2 provides a perspective view of a door and a damped closure assembly of the exemplary microwave oven appliance of FIG. 1, with the door in the open position.
Figure 3:
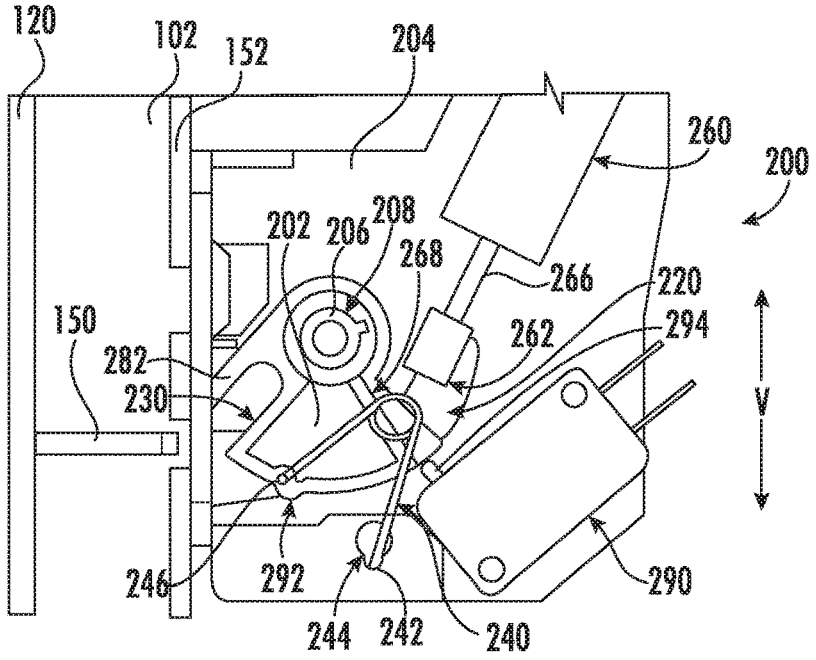
FIG. 3 provides a side view of the exemplary door and damped closure assembly of FIG. 2, with a catch element in an open position.
Figure 4:
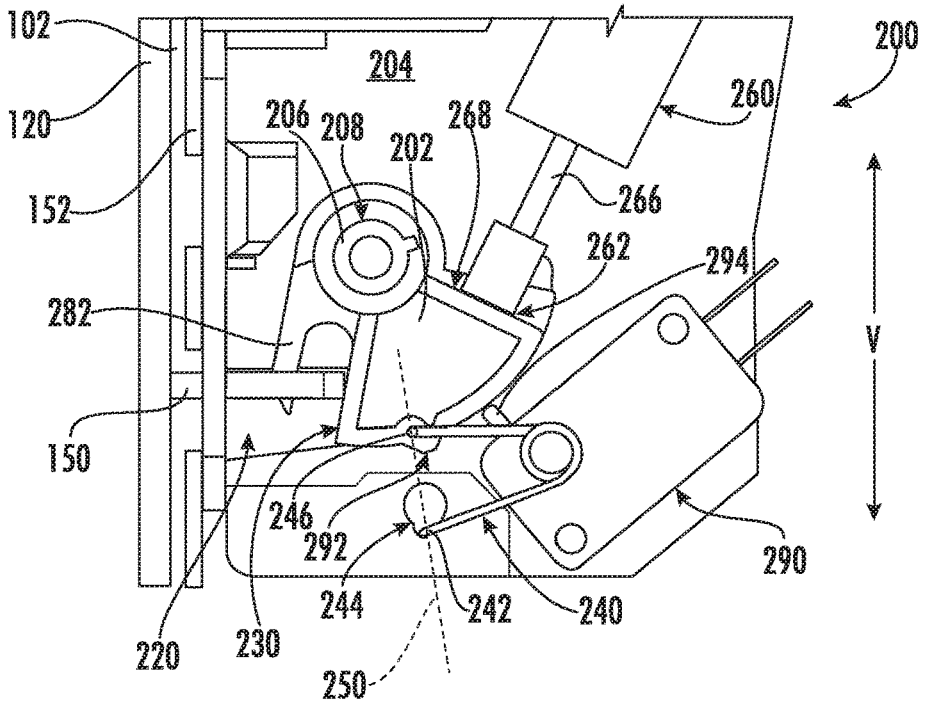
FIG. 4 provides a side view of the exemplary door and damped closure assembly of FIG. 2, with the catch element in an over-center position.
Figure 5:
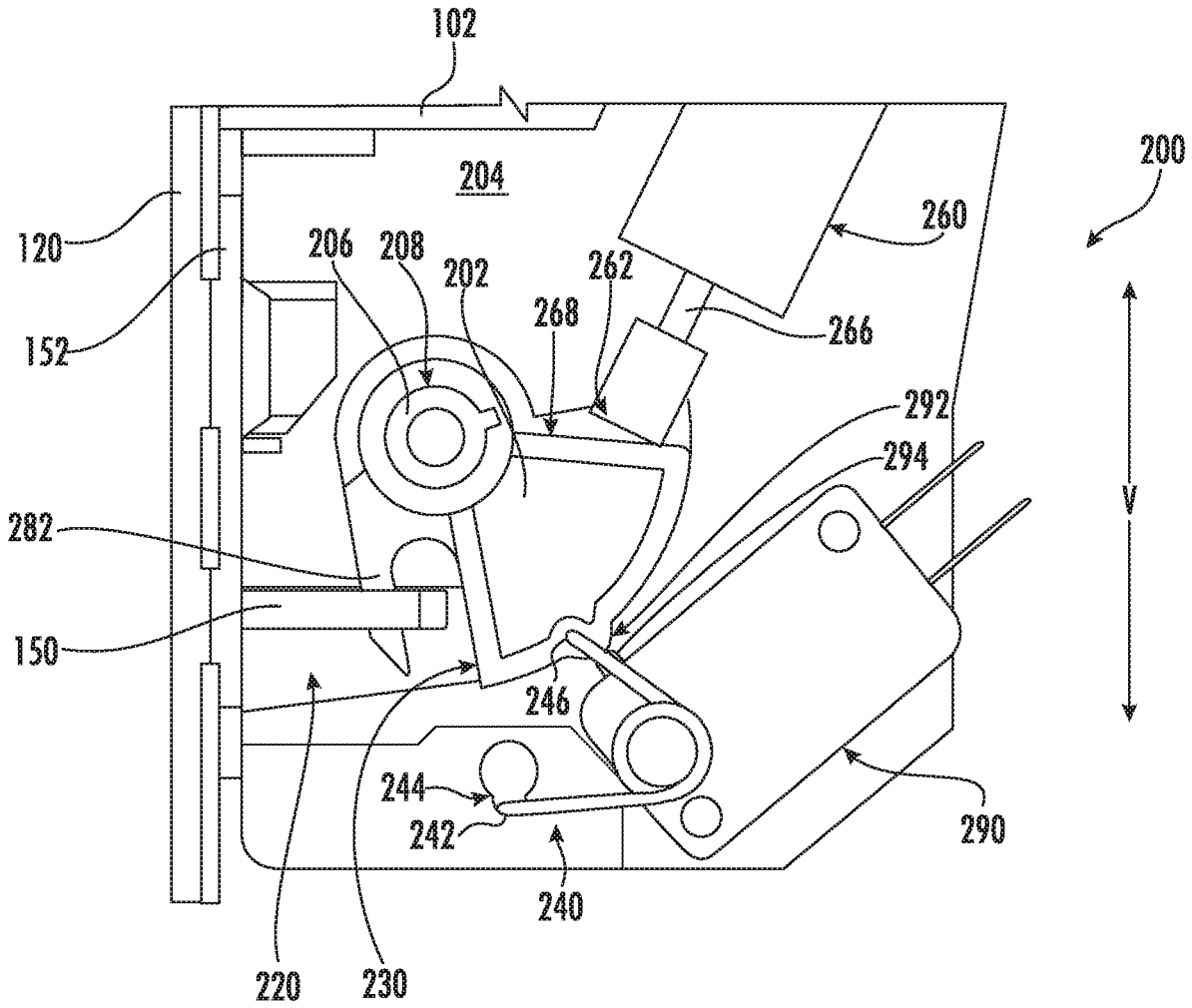
FIG. 5 provides a side view of the exemplary door and damped closure assembly of FIG. 2, with the catch element in a closed position.
Figure 6:
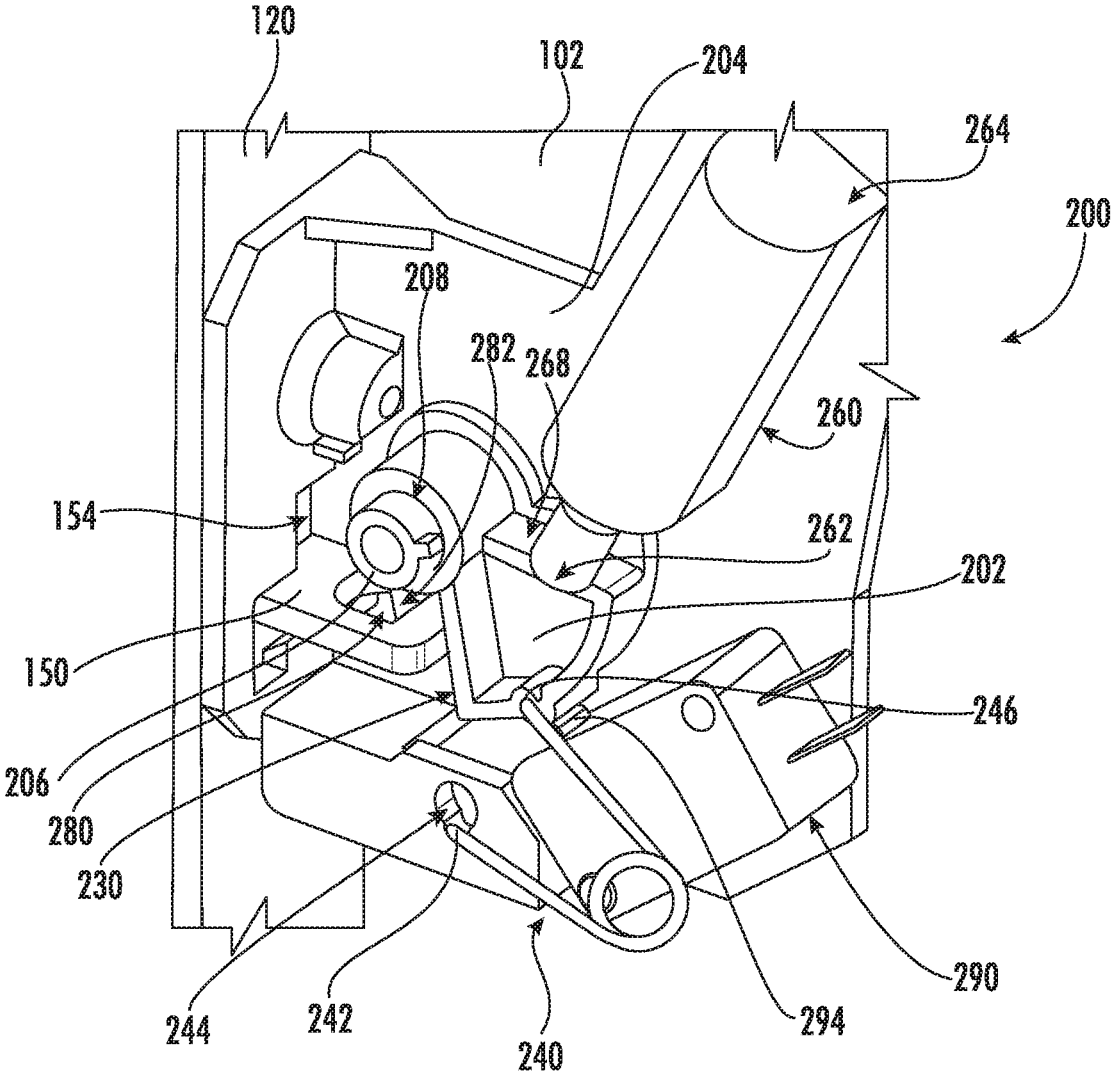
FIG. 6 provides a perspective view of the exemplary door and damped closure assembly of FIG. 2, with the door in the closed position.

Accordingly, according to aspects of the present subject matter, microwave oven 100 includes a damped closure assembly 200 that is mounted to or operably coupled to cabinet 102 and is generally configured for engaging and locking striker 150 in place while reducing the noise generated by such a latching process. Referring now to FIGS. 2 through 6, one exemplary embodiment of damped closure assembly 200 will be described. More specifically, FIGS. 2 and 6 provide perspective views of damped closure assembly 200 when door 120 is in an open and a closed position, respectively. In addition, FIGS. 3 through 5 illustrated damped closure assembly 200 as door 120 is moved progressively from the open to the closed position.

As illustrated, damped closure assembly 200 includes a catch element 202 that is generally configured for engaging striker 150 to lock door 120 in the closed position. According to the illustrated embodiment, catch element 202 (as well as many other components of damped closure assembly 200) are mounted to a base plate 204. Base plate 204 is securely fashioned to cabinet 102 and is designed to securely position, orient, and guide the rotation of the various components of damped closure assembly 200. However, it should be appreciated that according to alternative embodiments, damped closure assembly 200 and some or all of its components could be mounted directly to cabinet 102.

According to the illustrated embodiment, catch element 202 is a substantially circular component that is rotatably coupled to base plate 204 by a pin 206. In this regard, pin 206 may be coupled to or defined by base plate 204 and/or cabinet 102 for receipt in a hole 208 defined in the center of catch element 202. For example, pin 206 and hole 208 may be formed to permit catch element 202 to rotate about pin 206, e.g., within a plane perpendicular to the lateral direction L. Pin 206 and/or catch element 202 may further define one or more keyed features for locking catch element 202 to base plate 204.

In addition, catch element 202 and base plate 204 may be formed to have complementary features that guide the rotation of catch element 202 relative to base plate 204. For example, according to the illustrated embodiment, base plate 204 defines a guide channel 220 that is curved around pin 206 to guide the rotation of catch element 202. More specifically, catch element 202 may be at least partially positioned within guide channel 220 as catch element 202 pivots about pin 206.

Catch element 202 and guide channel 220 may be defined to permit the rotation of catch element 202 within a specified range to permit the movement of door 120 between an open position and a closed position. For example, according to one embodiment, catch element 202 and guide slot 220 may permit catch element 202 to rotate through a rotational arc or closing angle that is defined between the open position (see, e.g., FIG. 3) and the closed position (see, e.g., FIG. 5) of catch element 202. According to one embodiment, the closing angle is less than 90 degrees, and according to another embodiment the closing angle is between about 20 and 40 degrees. It should be appreciated that as used herein, terms of approximation, such as "approximately," "substantially," or "about," refer to being within a ten percent margin of error.

As best illustrated in FIGS. 3 through 5, catch element 202 is configured for engaging striker 150 as door 120 is moved toward the closed position. More specifically, when catch element 202 is in the open position, a striking surface 230 that is defined on catch element 202 is visible through opening 154 such that striker 150 engages and pushes striking surface 230 as door 120 is closed. In this manner, the operation of closing door 120 causes catch element 202 to begin rotating through the closing angle toward the closed position.

Notably, damped closure assembly 200 further includes the spring mechanism 240 which is operably coupled to catch element 202 and is positioned and oriented for facilitating the closing process of door 120. More specifically, according to the illustrated embodiment, spring mechanism 240 is a torsional spring having a rotating end 242 which is rotatably attached to a receiving slot 244 defined by base plate 204 and a traveling end 246 that is rotatably attached to catch element 202. In this manner, as catch element 202 is rotated from the open position to the closed position, spring mechanism 240 exerts a spring force on catch element 202. Notably, the magnitude and direction of the spring force depend on the position of catch element 202, and thus the compression and orientation of spring mechanism 240.

More specifically, spring mechanism 240 is configured for urging catch element 202 in opposite rotational directions depending on the angle of catch element 202 within guide slot 220. In this regard, spring mechanism 240 is configured for urging catch element 202 toward the open position when catch element 202 is positioned between the open position (see, e.g., FIG. 3) and an over-center position (see, e.g., FIG. 4). By contrast, when catch element 202 is positioned at a angle between the over-center position and the closed position (see, e.g., FIG. 5), spring mechanism 240 urges catch element 202 toward the closed position.

In this regard, because rotating end 242 of spring mechanism 240 is rotatably attached to base plate 204 but is prevented from translating (e.g., along the vertical or transverse directions), and because traveling end 246 both rotates and moves relative to base plate 204, there is a position, referred to herein as the over-center position, at which the force exerted by spring mechanism 240 changes directions relative to catch element 202 or guide slot 220. For example, when a line 250 (as shown in FIG. 4) that is defined between the rotating end 242 traveling end 246 is substantially parallel to the vertical direction V, spring mechanism 240 may be in the over-center position. Any further rotation of catch element 202 towards the closed position will cause the rapid acceleration of catch element 202 toward the closed position.

However, to prevent the rapid acceleration of catch element 202 toward the closed position, and thus to prevent a loud striking noise when catch element 202 reaches the end of guide channel 220, damped closure assembly 200 further includes the damping element 260 that is operably coupled to catch element 202 for damping the rotation of catch element 202 toward the closed position. More specifically, damping element 260 includes a first end 262 configured for engaging catch element 202 and a second end 264 that is fixed relative to cabinet 102, or more specifically, to base plate 204. In this regard, for example, first end 262 of damping element 260 at the end of a sliding damping rod 266 and catch element 202 may define an engagement surface 268 for receiving first end 262.

According to the exemplary embodiment, first end 262 of damping element 260 extends toward engagement surface 268 of catch element 202, but does not engage catch element 202 until after it rotates through the over-center point when moving toward the closed position. In this manner, as catch element 202 rotates from the open position to the over-center position, damping element 260 is disengaged and spring mechanism 240 is urging door 120 back into the open position. However, after door 120 is closed to the point where catch element 202 passes the over-center position, spring element 240 urges door 120 and catch element 202 closed, at which point damping element 260 engages to slow the movement of catch element 202 toward the closed position. As shown in FIG. 4, damping element 260 contacts engagement surface 268 when catch element 202 is at the over-center point. However, it should be appreciate that according to alternative embodiments, a gap may be defined between first end 262 of damping element 260 and catch element 202 when catch element 202 is in the over-center position. In this manner, damping element 260 may engage catch element 202 only after catch element has passed the over-center position.

Any suitable, type, number, and configuration of damping elements 260 may be selected depending on the application. For example, the stiffness of damping element 260 may be selected such that the rotational velocity of catch element 202 does not exceed a predetermined value. In this manner, spring mechanism 240 and damping element 260 act collectively to slowly move catch element 202 and door 120 to the closed position. More specifically, during operation, as door 120 is moved toward the closed position, striker 150 engages engagement surface 268, thereby rotating catch element 202 toward the closed position. The momentum of door 120 and the force of spring mechanism 240 draw catch element 202 into the closed position, while damping element 260 counteracts the closing momentum to achieve the slow-close operation. By contrast, when door 120 is pulled toward the open position, striker 150 pulls on catch element 202 (e.g., via latch arm 282 described below), such that catch element 202 is rotated into the open position before striker 150 and door 120 disengages catch element 202 and damped closure assembly 200.

As illustrated in FIGS. 2 through 6, catch element 202 may further define features for engaging striker 150 to lock it in position when door 120 is closed. In this regard, striker 150 may define a latch aperture 280 that is configured for receiving a latch arm 282 defined by catch element 202. More specifically, latch aperture 280 may be defined along a vertical direction V through striker 150 and latch arm 282 may rotate downward (or upward) through latch aperture 282 prevent door 120 from being opened without rotating catch element 202 back into the open position. Notably, the interaction between striker 150 and striking surface 230 of catch element 202 (as door 120 is closed) and between striker 150 and latch arm 282 of catch element 202 (as door 120 is opened) ensures that catch element 202 moves between the open position and the closed position along with door 120.

Damped closure assembly 200 may further include a switch element 290 for detecting when the catch element 202 is in the closed position. For example, switch element 290 may be mounted to base plate 204 (or directly to cabinet 102) and may be engaged by catch element 202 when door 120 is closed. In addition, catch element 202 may define a protrusion 292 is configured for engaging a trigger 294 of switch element 290 when catch element 202 (and thus door 120) is in the closed position. Switch element 290 may be coupled to a controller, such as appliance controller 140, and may be used to prevent operation of microwave oven 100 when door 120 is open.

It should be appreciated that damped closure assembly 200 is used only for the purpose of explaining aspects of the present subject matter. Modifications and variations may be made to microwave oven 100 or damped closure assembly 200 while remaining within the scope of the present subject matter. For example, the size, configuration, position, and operation of striker 150 and/or catch element 202 may vary, the geometry of guide channel 220 and the positioning of spring mechanism 240 and damping element 260 may be adjusted to control their interaction and the resulting closing motion of door 120, and the spring tension and damper resistance may be adjusted while remaining within the scope of the present subject matter.

Damped closure assembly 200 as described above provides a simple and effective mechanism for ensuring door 120 of microwave oven 100 is closed slowly to prevent slamming, loud noises, and potential wear on one or more components of damped closure assembly 200 or microwave oven 100. In addition, damped closure assembly 200 may be adjusted to meet the needs of any particular application. For example, the illustrated embodiment shows a single torsion spring and linear damper. Other potential embodiments include using multiple tension springs, as well as rotary dampers. In addition, switch element 290 may be engaged by catch element 202, spring mechanism 240, striker 150, or any other moving member of microwave oven 100 to indicate door 120 is in the closed position. Thus, damped closure assembly 200 provides a convenient, versatile, and effective means for slowly and completely closing door 120 in a manner that improves microwave oven 100 operation and consumer satisfaction. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave oven defining a vertical, a lateral, and a transverse direction, the microwave oven comprising:

a cabinet defining a cooking chamber;

a door rotatably mounted to the cabinet for providing selective access to the cooking chamber, the door comprising a striker mounted to the door; and a damped closure assembly mounted to the cabinet, the damped closure assembly comprising:

a catch element mounted to the cabinet, the catch element being rotatable between an open position and a closed position, the catch element being configured for engaging the striker when the catch element is moved toward the closed position;

a spring mechanism operably coupled to the catch element, the spring mechanism being positioned and oriented for urging the catch element toward the open position when the catch element is positioned between the open position and an over-center position and for urging the catch element toward the closed position when the catch element is positioned between the over-center position and the closed position, wherein the spring mechanism comprises a rotating end that is rotatably attached to the cabinet and a traveling end that is rotatably attached to the catch element, and wherein the catch element is in the over-center position when a line that extends between the rotating end and the traveling end is substantially parallel to the vertical direction; and a damping element operably coupled to the catch element for damping the rotation of the catch element toward the closed position.

2. The microwave oven of claim 1, wherein the striker defines a latch aperture and the catch element defines a latch arm for engaging the latch aperture when the catch element is moved toward the closed position.

3. The microwave oven of claim 1, wherein the catch element defines an engagement surface for engaging the damping element.

4. The microwave oven of claim 3, wherein the damping element comprises a sliding damping rod that engages the engagement surface after the catch element passes the over-center point when moving toward the closed position.

5. The microwave oven of claim 3, wherein a gap is defined between an end of the damping element and the engagement surface of the catch element when the catch element is in the over-center position.

6. The microwave oven of claim 1, wherein the damped closure assembly comprises a base plate mounted to the cabinet, the catch element and the rotating end of the spring mechanism being mounted to the base plate.

7. The microwave oven of claim 6, wherein the catch element is rotatably mounted to the base plate by a pin, the base plate defining an arcuate guide channel within which the catch element rotates.

8. The microwave oven of claim 1, wherein the spring mechanism is a torsional spring.

9. The microwave oven of claim 1, wherein the damped closure assembly further comprises a switch element for detecting when the catch element is in the closed position.

10. The microwave oven of claim 9, wherein the switch element is mounted to the base plate and is engaged by the catch element when the door is in the closed position.

11. The microwave oven of claim 1, wherein the cabinet comprises a front panel defining an opening, the striker being received within the opening when the door moves the catch element to the closed position.

12. The microwave oven of claim 1, wherein the damped closure assembly is a first damped closure assembly and the striker is a first striker, the microwave oven further comprising:

a second damped closure assembly mounted to the cabinet and being spaced apart from the first damped closure assembly to engage a second striker mounted on the door.

13. The microwave oven of claim 1, wherein the catch element rotates within a plane perpendicular to the lateral direction.

14. The microwave oven of claim 1, wherein the catch element rotates through a closing angle between the open position and the closed position, the closing angle being between about 20 and 40 degrees.

15. A damped closure assembly for an oven appliance, the oven appliance comprising a cabinet defining a cooking chamber and a door for providing selective access to the cooking chamber, the damped closure assembly comprising:

a catch element mounted to the cabinet, the catch element being rotatable between an open position and a closed position, the catch element being configured for engaging a door striker when the catch element is moved toward the closed position;

a spring mechanism operably coupled to the catch element, the spring mechanism being positioned and oriented for urging the catch element toward the open position when the catch element is positioned between the open position and an over-center position and for urging the catch element toward the closed position when the catch element is positioned between the over-center position and the closed position, wherein the spring mechanism comprises a rotating end that is rotatably attached to the cabinet and a traveling end that is rotatably attached to the catch element, and wherein the catch element is in the over-center position when a line that extends between the rotating end and the traveling end is substantially parallel to the vertical direction; and a damping element operably coupled to the catch element for damping the rotation of the catch element toward the closed position.

16. The damped closure assembly of claim 15, wherein the door striker defines a latch aperture and the catch element defines a latch arm for engaging the latch aperture when the catch element is moved toward the closed position.

17. The damped closure assembly of claim 15, wherein the damping element comprises a sliding damping rod that engages an engagement surface defined by the catch element after the catch element passes the over-center point when moving toward the closed position.

18. The damped closure assembly of claim 15, wherein the damped closure assembly comprises a base plate mounted to the cabinet, the catch element being mounted to the base plate.

19. The damped closure assembly of claim 18, wherein the spring mechanism is a torsional spring.

20. The damped closure assembly of claim 15, wherein the damped closure assembly further comprises a switch element mounted to the base plate, the switch element being engaged by the catch element when the door is in the closed position.

* * * * *